US006050418A

United States Patent [19]

Kohler

[11] Patent Number: 6,050,418

[45] Date of Patent: Apr. 18, 2000

[54] PORTABLE COSMETIC CASE

[76] Inventor: Barbara Kohler, 265 Union St., Brooklyn, N.Y. 11231

[21] Appl. No.: 09/122,725

[22] Filed: Jul. 27, 1998

[51] Int. Cl.[7] ..... B65D 69/00

[52] U.S. Cl. ..... 206/581; 206/38

[58] Field of Search ..... 206/5, 5.1, 38, 206/581; 220/4.22, 4.23; 132/295, 296

[56] References Cited

U.S. PATENT DOCUMENTS

| | | | |
|---|---|---|---|
| 4,925,017 | 5/1990 | Jessen | 206/5.1 |
| 5,007,531 | 4/1991 | Lighten | 206/581 |
| 5,299,683 | 4/1994 | Poole | 206/581 |
| 5,323,924 | 6/1994 | Wolff | 206/581 |
| 5,375,699 | 12/1994 | Amend | 206/5.1 |
| 5,439,572 | 8/1995 | Pankow | 206/5.1 |

*Primary Examiner*—David T. Fidei

*Attorney, Agent, or Firm*—Thomas A. O'Rourke; Wyatt, Gerber, Meller & O'Rourke

[57] ABSTRACT

A storage case for cosmetics and contact lenses is disclosed. The lens case has a front member and a rear member in which the front and rear members have an interior surface and an exterior surface and a top edge and a bottom edge and two side edges. The front member and rear member are hingedly connected together at one of the side edges and the remaining side edges are unconnected to each other but in contact with each other when the case is in a closed condition. The case is retained in a closed condition by a receptacle that is positioned within the case and the case is in an open condition when the receptacle is removed from within the case.

12 Claims, 6 Drawing Sheets

PORTABLE COSMETIC CASE

The subject matter of the present invention relates to improved portable storage devices for cosmetics and related products. The types of products that may be stored include but are not limited to, cakes of powder, mascara and the like. Particularly appropriate for use in connection with the present invention are those products that are applied by the wearer from time to time at locations where the facilities are less than optimum. The case of the present invention is particularly advantageous because of its compact and light-weight design. The case of the present invention is also inexpensive to produce as it can be injection molded out of a polymeric material.

Typically, the case may be carried in a pocket book, handbag, or even in a pocket without causing unsightly bulging or undue strain to the user carrying the case. The present invention also provides a storage case that may include a mirror as well as a receptacle to store, for example, liquids and semi-liquids, such as perfume, rubbing alcohol, lotions, cold cream and similar products that may be carried by the user as desired.

The present invention also has application in the care and storage of contact lenses and contact lens solution. In particular, the case of the present invention provides an improved lens holder that furnishes not only a storage area for the lenses but also includes a mirror to facilitate the insertion and removal of the lenses by the user. More particularly, the present invention also provides a means to incorporate a lens case with a mirror as well as a container for the appropriate contact lens fluid.

Since their introduction many years ago contact lenses have achieved tremendous popularity among those with poor eyesight. While they may be purchased for cosmetic purposes many wearers find that the lenses provide better vision than can be achieved with glasses. Persons active in sports and other physical activities frequently find that contact lenses enable the wearer to participate more fully in the activity than would be otherwise possible wearing glasses. Although contact lenses provide the wearer a great deal of freedom that could not be achieved by wearing glasses, contact lenses are not without their drawbacks. For example, wearers of hard lenses are usually able to wear these lenses comfortably for relatively short periods of time due to the oxygen and moisture impervious nature of the lenses. While wearers of soft lenses are able to wear these lenses for significantly longer periods of time, the wearer cannot wear the lenses indefinitely without discomfort or worse, damaging the eye. Even users of extended wear contact lenses that theoretically permit the wearer to sleep with lenses overnight must remove the lenses periodically to clean them and enable the wearer to oxygenate the eyes.

Many people who wear contact lenses have to, for a variety of reasons, remove the lenses from their eyes at inconvenient times. There are also times when the user must remove and store the lenses away from home. For example, a wearer who is spending any extended time in a smoke-filled environment may desire to remove the lenses for better comfort. Other times, after a period of extended wear, a person may find that the eyes are not tearing as much as is necessary and the dryness is causing concern or even just discomfort. In those instances a wearer will also want to remove the lenses as soon as is reasonably possible. As a result, there is a need for a means to conveniently store the lenses in an appropriate environment to protect them and keep them moist and uncontaminated.

As can be seen from the above, a contact lens wearer may, from time to time, have to remove the lenses but one does not necessarily know or is unable to predict when these times will occur. Accordingly, there is a need for contact lens wearers to store their lenses in a convenient storage article. It is also necessary that the storage device for the lenses provide for a means for storing contact lens fluid and to have access to a mirror in an article that takes up small amounts a space and is lightweight.

SUMMARY OF THE INVENTION

The present invention is directed to a cosmetic case that may include a cosmetic material and a mirror that may be stored within the case. The case also includes a receptacle for storing liquids and semi-liquids. The storage receptacle is designed to be stored within the case. The presence of the container within the case provides the ability to lock the case in its unopened condition. The present invention is also directed to a case which closes to a compact condition but when opened provides a mirror for use in inserting the contact lenses into the eyes as well as individual receptacles for storing contact lenses.

The case of the present invention typically has a "clam shell" arrangement with a pair of members hingedly connected together on one side. The two members are arranged such that a receptacle may be inserted within or between the two members when the case is in a closed condition. The receptacle is provided with a means for retaining or locking the members together in a closed position when the receptacle is properly inserted between the members. When the two members are in an open position one member is adapted to rest on a work surface, i.e., usually for ease of use, a generally horizontal position. The work surface may be a table or any other suitable surface. The other member is in a general, but not necessarily, vertical position when the case is opened. When the case is in an opened position, the mirror within the case is in a raised position, i.e., in a generally vertical position. The mirror enables the user to apply make-up, insert contact lenses into the eyes or aid in their removal. Extending generally horizontally from the top edge of the mirror to the vertical member is a horizontal ledge or shelf. This ledge or shelf may have a recess in its top surface for any appropriate cosmetic material that the user intends to apply. In one preferred embodiment the upper surface of the shelf has a pair of concave depressions in the surface that are adapted to receive contact lenses for storage.

DETAILED DESCRIPTION OF THE INVENTION

Figure 4:
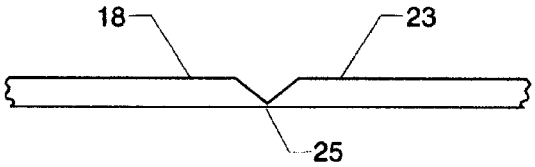
FIG. 4 is a side view of a hinge of the present invention when the case is opened.

The case 10 of the present invention has a front member 11 and a rear member 12. The front member 11 has an interior surface 13 and an exterior surface 14. The front member has a top edge 15 and a bottom edge 16 and two side edges 17 and 18. Similarly, the rear member 12 has an interior surface 19 and an exterior surface 20. The rear member has a top edge 21 and a bottom edge 22 and two side edges 23 and 24. In a preferred embodiment of the present invention the front member 11 and the rear member 12 are preferably mirror images of each other. The front member 11 and rear member are hingedly connected together at edges 18 and 23 by a hinge means 25. The hinge means may be any suitable hinge that is known to one skilled in the art and can either be a separate hinge adhered or connected to the front and rear members by any suitable means or it may be integral with the front and rear members, for example, as shown in FIG. 4. It has been found that when the case is made from a polymeric material such as polyethylene, polypropylene or polystyrene a hinge means as shown in FIG. 4 is usually suitable. The polyethylene may be a low density polyethylene, a linear low density polyethylene or a polyethylene made from a single site catalyst resin.

Figure 1:
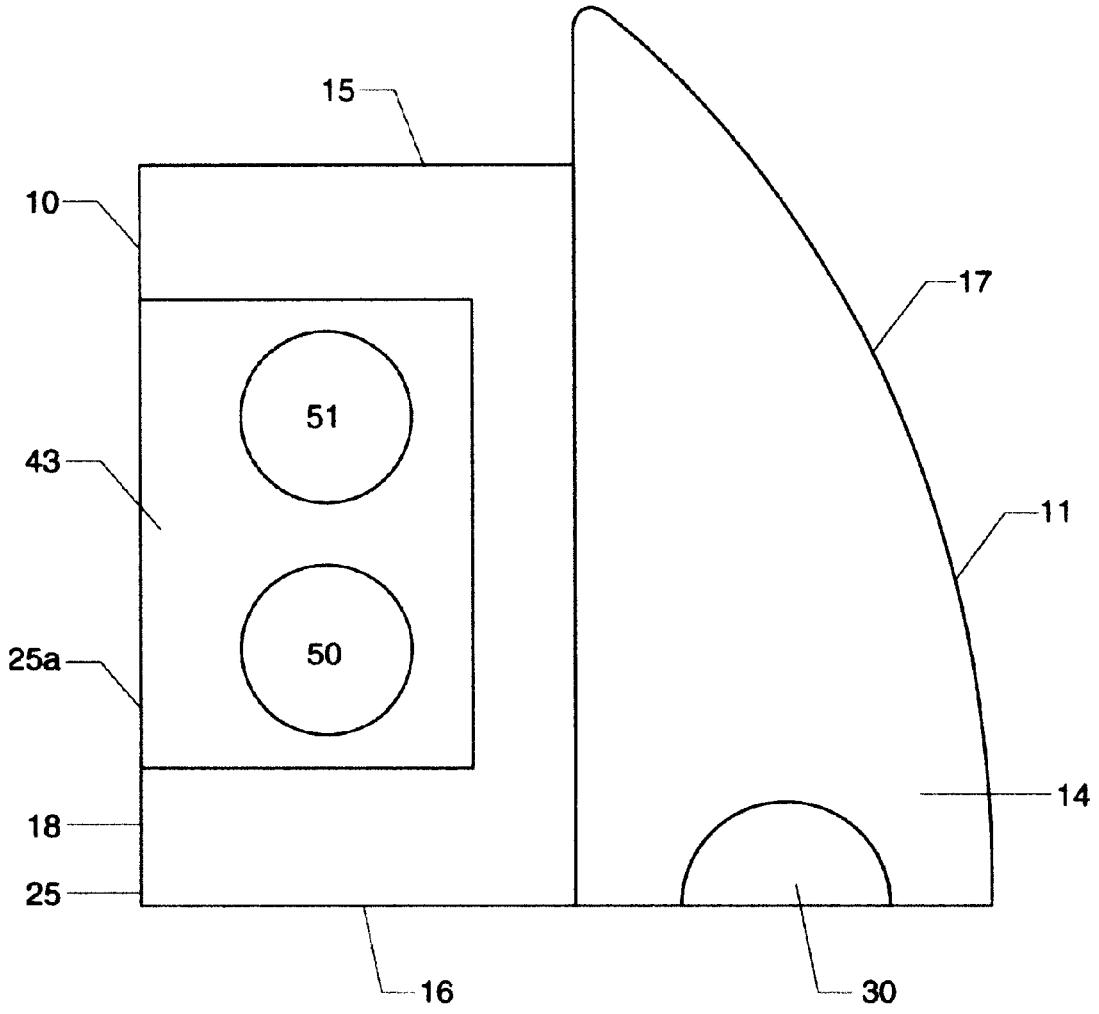
FIG. 1 is a front view of the case of the present invention with the receptacle in place within the case and thereby locking the case in a closed position.
Figure 1A:
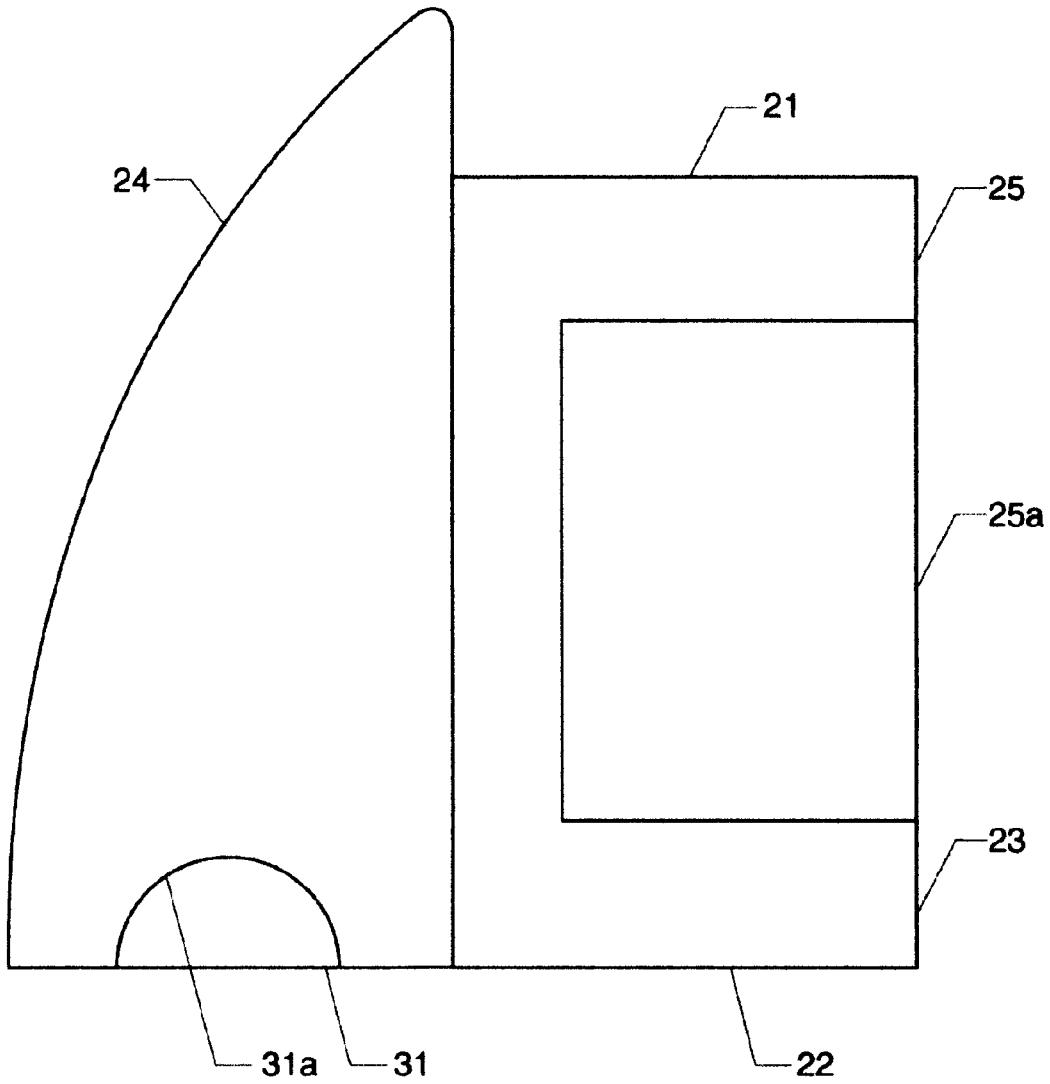
FIG. 1A is a rear view of the case of the present invention with the receptacle in place within the case and thereby locking the case in a closed position.
Figure 2:
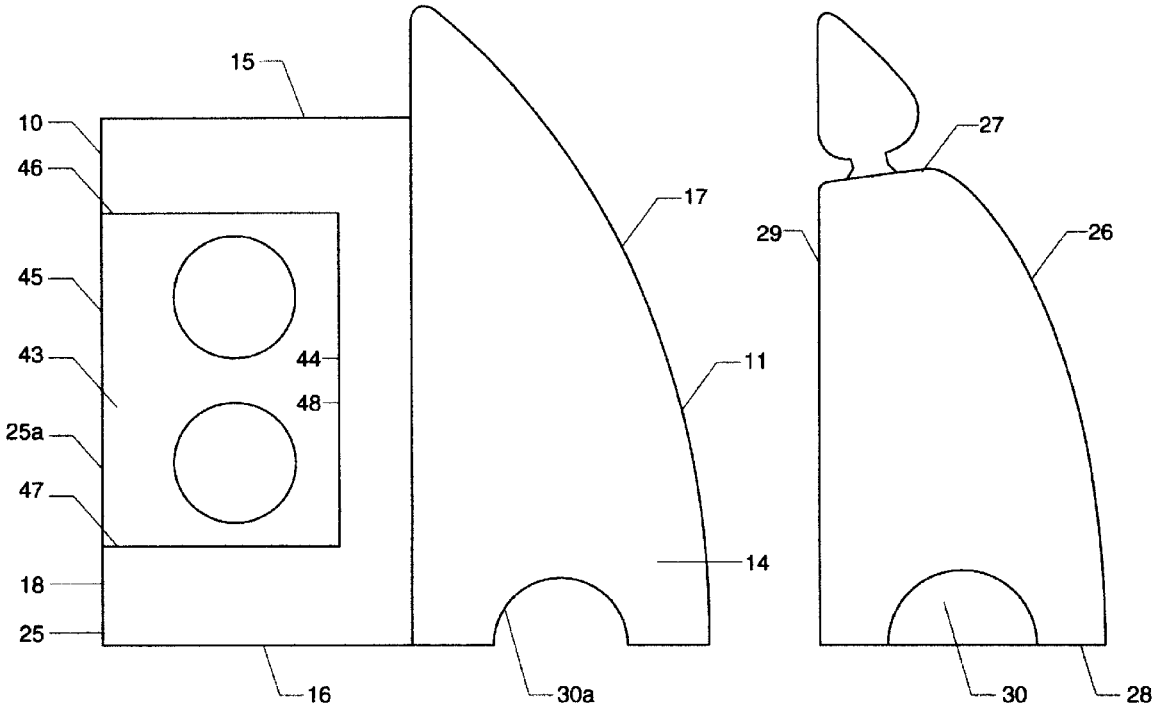
FIG. 2 is a front view of the case of the present invention in the closed position with the receptacle removed from the case and standing adjacent thereto.
Figure 2A:
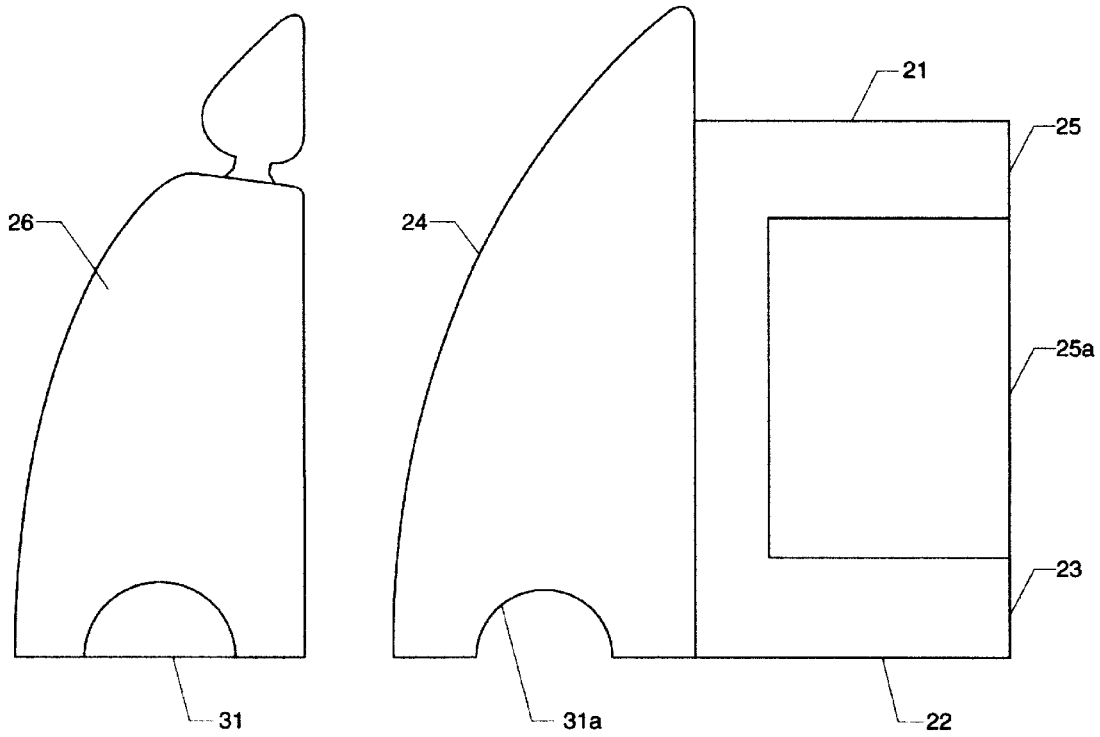
FIG. 2A is a rear view of the case of the present invention in the closed position with the receptacle removed from the case and standing adjacent thereto.
Figure 3:
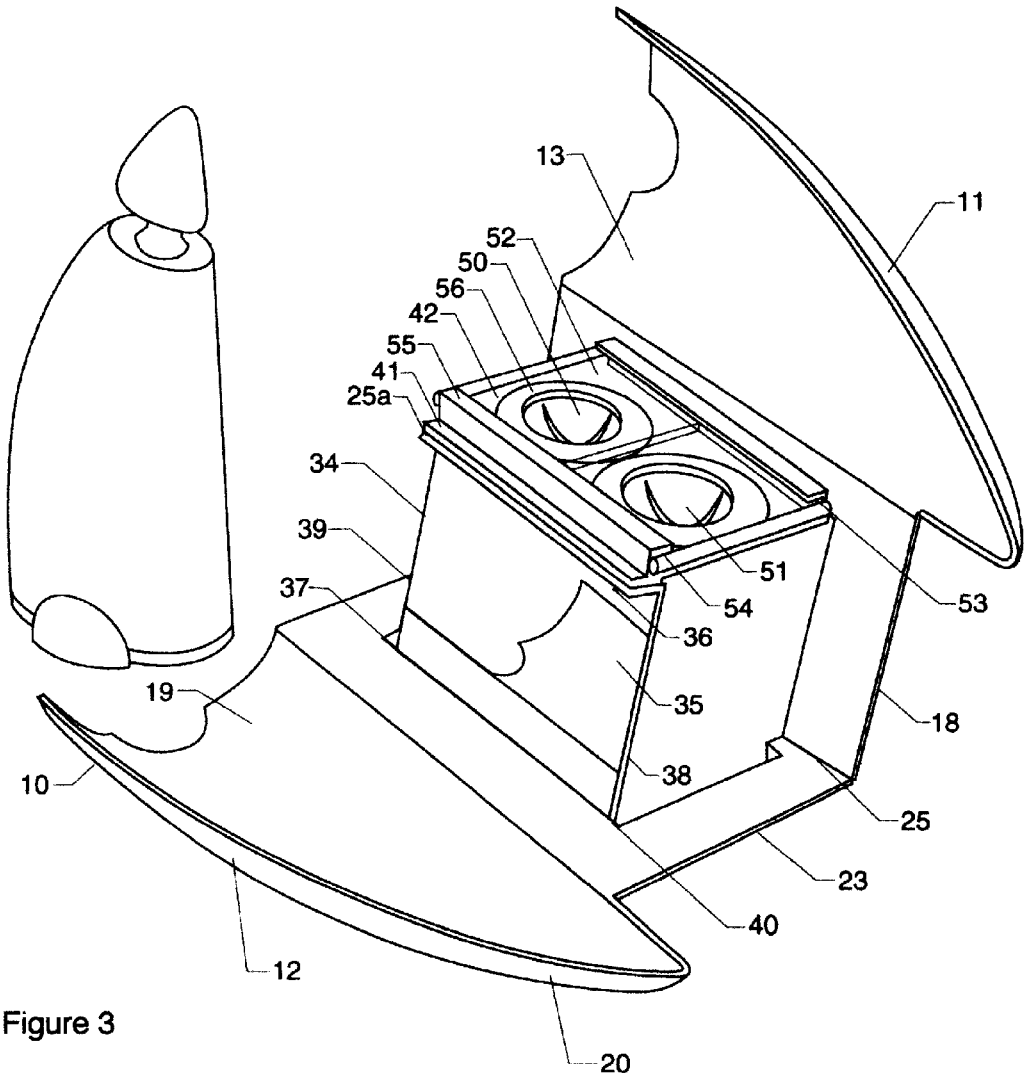
FIG. 3 is a view of the case in an opened condition.
Figure 5:
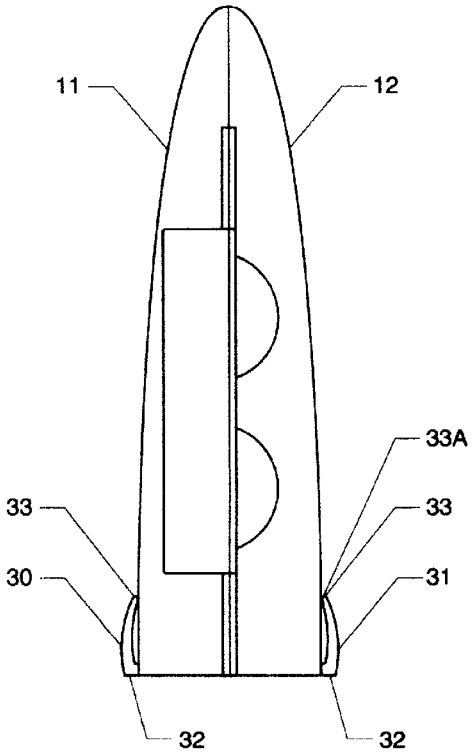
FIGS. 5 and 6 are a side views of the case of the present invention showing the locking means for retaining the case in a closed condition.
Figure 6:
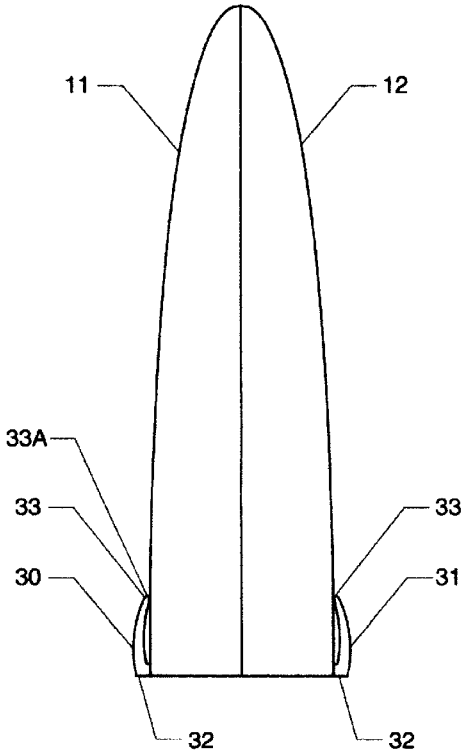

Side edges 17 and 24 are unconnected to each other unlike edges 18 and 23, although the edges 17 and 24 do contact each other when the case is in a closed condition. The case is held or locked in a closed condition when the receptacle 26 is appropriately positioned within the case as shown in FIGS. 5 and 6. The receptacle 26 includes a top 27 a bottom 28 and side wall 29. The receptacle or container may be any shape. Extending generally outwardly from the side wall of the container is a pair of locking means 30 and 31 which serve as the means for retaining the case in a closed condition. The locking means may preferably be attached to the lower portion of the side wall 29 of the receptacle. Typically, the locking means has a member 32 that extends from the sidewall. Preferably, the member 32 extends in a direction that is generally horizontal when the bottom of the receptacle is placed on a horizontal surface. The member 32 does not, however, have to be parallel to the bottom surface of the receptacle or even in the same plane as the bottom of the receptacle. Extending upwardly from each member 32 is a flange 33. The flanges 33 are adapted to extend over a portion of the front and rear member such that the case is unable to open when the receptacle is in position within the case and each flange extends over a portion of its respective front or back member. As shown in FIGS. 2A and 3, the flanges 33 are larger in size than the corresponding openings 30*a* and 31*a* in front member 11 and rear member 12 respectively. Since each flange is slightly larger than its corresponding opening the flanges prevent the side walls from opening about the hinge means. When the receptacle is removed from the case, usually by grasping or pulling on the flanges, the case is thereby permitted to open about the hinge means as shown in FIGS. 5 and 6. The flanges preferably curved slightly inwardly towards the front or rear member to contact the front and rear member at the upper inner surface 33*a* of the flange 33 to provide a friction surface to prevent the receptacle from falling free of the case at inopportune moments.

As the case is opened, a portion 34 of the inner surface of the rear member rises to a generally vertical position to form a leg. This leg is formed from a center portion of the rear member 12 and preferably has a mirrored interior surface 35 thereon. The wall surface 34 has a top edge 36 a bottom edge 37 and two side edges 38 and 39. The bottom edge 37 is hingedly connected to the remainder of the rear member by a second hinge means 40. This hinge means may be similar to hinge means 25 or may be a different means. The top edge 36 of wall surface 34 is hingedly connected to wall surface 41 which is a portion of the front member 11. Wall surface 41 has an interior surface 42 and an exterior surface 43, a top edge 44, a bottom edge 45 and two side edges 46 and 47. Top edge 44 is hingedly connected by hinge means 48 to front member 11. Bottom edge 45 is hingedly connected to wall surface 34 by hinge means 25A. The particular arrangement of the wall surfaces 34 and 41 when the case is opened fixes the two surfaces in position and prevents the case from closing unless desired. The interior surface 42 of the wall surface may be provided with a recessed portion that may hold any suitable material. As seen in the figures, in a preferred embodiment, there may be a pair of generally concave generally hemispherical depressions 50 and 51 that are adapted to receive each lens of a pair of contact lenses. When the recess is used to store contact lenses or other sensitive materials there is a cover means 52 that protects the stored material. The cover means may be held in place by a pair of tracks 53 and 54 that have an upper surface 55 extending inwardly toward each other. The cover means is inserted under the upper surface 55 which holds the cover in place. It is preferred that a sealing ring 56 or other sealing means be present between the cover and the interior surface 42 to prevent evaporation of moisture. The sealing ring may be made of any suitable material such as silicon. When the recess is to carry contact lenses, it is preferred that there be a pair of ribs and in each recess the keep the lenses from sticking to the bottom.

I claim:

1. A storage case comprising a front member and a rear member, said front and rear member having an interior surface and an exterior surface and a top edge and a bottom edge and two side edges, said front member and rear member being hingedly connected together at one of said side edges, said remaining side edges being unconnected to each other but in contact with each other when the case is in a closed condition, said case being retained in a closed condition by a receptacle positioned within the case and in an open condition when said receptacle is removed from within the case.

2. A storage case comprising a front member and a rear member, said front and rear member having an interior surface and an exterior surface and a top edge and a bottom edge and two side edges, said front member and rear member being hingedly connected together at one of said side edges, said remaining side edges being unconnected to each other but in contact with each other when the case is in a closed condition, said case being retained in a closed condition by a receptacle positioned within the case, and wherein said receptacle has a top, a bottom and a side wall and having a pair of locking means extending outwardly from the side wall of the receptacle, said locking means extending from the lower portion of the side wall of the receptacle and comprising a member which extends outwardly from the sidewall having a flange extending upwardly therefrom and wherein the flanges are adapted to extend over a portion of the front and rear member such that the case is unable to open when the receptacle is in position within the case.

3. A storage case comprising a front member and a rear member, said front and rear member having an interior surface and an exterior surface, said front member and rear member being hingedly connected together at an edge and being in contact with each other when the case is in a closed condition, said case being retained in a closed condition by a receptacle positioned within the case, said receptacle having a pair of side walls and wherein said receptacle has a locking means extending outwardly from the side walls of the receptacle, said locking means extending from the lower portion of the side wall of the receptacle and comprising a member which extends outwardly from the sidewall having a flange extending upwardly therefrom and wherein the flanges are adapted to extend over a portion of the front and rear member such that the case is unable to open when the receptacle is in position within the case.

4. The case of claim 1 wherein the receptacle has a top, a bottom and a side wall and having a pair of locking means extending outwardly from the side wall of the container is a pair of locking means.

5. The case of claim 4 wherein each locking means extends from the lower portion of the side wall of the receptacle and comprises a member which extends outwardly from the sidewall having a flange extending upwardly therefrom.

6. The case according to claim 3 wherein when the receptacle is removed from the case, the case opens about the hinge means and a portion of the inner surface of the rear member rises to form a leg formed from a center portion of the rear member said leg having a top edge, a bottom edge and two side edges and wherein the bottom edge of said leg is hingedly connected to the remainder of the rear member by a second hinge means and the top edge of said leg is hingedly connected to a wall surface which is a portion of the front member, said wall surface having an interior surface and an exterior surface, a top edge, a bottom edge and two side edges said top edge of said wall surface being hingedly connected by a hinge means to said front member 11 and said bottom edge is hingedly connected to said wall surface by a third hinge means.

7. The case according to claim 6 wherein the inner surface of said leg is mirrored.

8. The case according to claim 7 wherein the interior surface of the wall surface is provided with a recessed portion.

9. The case according to claim 8 wherein there are a pair of generally concave recesses adapted to receive each lens of a pair of contact lenses.

10. The case according to claim 8 wherein said case is adapted to receive a cover over said recess.

11. The case according to claim 10 wherein the cover means is held in place by a pair of tracks extending from said wall surface, each of said tracks having an upper surface extending inwardly toward each other.

12. The case according to claim 11 further comprising a sealing means be between the cover and the interior surface.

* * * * *